US005586870A

United States Patent [19]

Kawaguchi et al.

[11] Patent Number: 5,586,870

[45] Date of Patent: Dec. 24, 1996

[54] BEARING STRUCTURE USED IN A COMPRESSOR

[75] Inventors: Masahiro Kawaguchi; Masanori Sonobe; Shigeki Kanzaki; Tomohiko Yokono, all of Kariya, Japan

[73] Assignee: Kabushiki Kaisha Toyoda Jidoshokki Seisakusho, Kariya, Japan

[21] Appl. No.: 277,347

[22] Filed: Jul. 19, 1994

[30] Foreign Application Priority Data

Jul. 20, 1993 [JP] Japan ..... 5-179394

[51] Int. Cl.[6] ..... F04B 1/29

[52] U.S. Cl. ..... 417/222.2; 417/269; 417/270; 417/362; 91/499

[58] Field of Search ..... 417/269, 222.1, 417/222.2, 362, 270; 384/547; 92/12.2; 91/499, 506

[56] References Cited

U.S. PATENT DOCUMENTS

| | | | |
|---|---|---|---|
| 4,444,092 | 4/1984 | Schott | 91/506 |
| 5,059,097 | 10/1991 | Okazaki et al. . | |
| 5,391,058 | 2/1995 | Goto et al. | 417/269 |

FOREIGN PATENT DOCUMENTS

| | | | |
|---|---|---|---|
| 0102691 | 6/1983 | European Pat. Off. . | |
| 0510496 | 4/1992 | European Pat. Off. . | |
| 3810099 | 10/1988 | Germany | 417/222.2 |
| 4002196 | 8/1990 | Germany . | |
| 63-183277 | 7/1988 | Japan . | |
| 4262096 | 9/1992 | Japan . | |

OTHER PUBLICATIONS

European Search Report for European Patent Application No. 94 11 1226.01 dated Nov. 14, 1994.

*Primary Examiner*—Timothy Thorpe
*Assistant Examiner*—William Wicker
*Attorney, Agent, or Firm*—Brooks Haidt Haffner & Delahunty

[57] ABSTRACT

A compressor includes a rotary drive shaft having a first end and a second end, both the ends being rotatably supported by opposing walls of a crank chamber defined in a casing and a swash plate tiltably mounted on the drive shaft and operably coupled with a piston in a cylinder bore. A rotation of the drive shaft results in a reciprocating movement of the piston for compressing refrigerant gas in a cylinder bore. A rotary member is secured to the first end which extends outside the casing. the rotary member supplies a power to the drive shaft from a power supply. A support member, disposed between the rotary member and the first end, protrudes outward from the casing. A first bearing, disposed between the support member and the rotary member, receives a thrust load and a radial load acting on the rotary member when the rotary member rotates. A second bearing, disposed between the casing and the second end, receives the radial load acting on the rotary member when the rotary member rotates.

17 Claims, 7 Drawing Sheets

BEARING STRUCTURE USED IN A COMPRESSOR

BACKGROUND OF THE INVENTION

1. Field of the Invention

The present invention relates to a shaft supporting structure in a compressor, in which a single-head piston is reciprocatable in a cylinder bore and a swash plate is tiltabley supported on a rotary shaft in crank chamber, and which controls the inclined angle of the swash plate based on the difference between pressure in a crank chamber and suction pressure.

2. Description of the Related Art

In general, compressor units used in automobiles, trucks and the like are used to supply compressed refrigerant gas to the vehicle's air conditioning system. To maintain air temperature inside the vehicle at a level comfortable for the vehicle's passengers, it is important to utilize a compressor whose displacement amount of the refrigerant gas is controllable. One known compressor of this type controls the inclined angle of a swash plate, tiltably supported on a rotary shaft, based on the difference between the pressure in a crank chamber and the suction pressure, and converts the rotational motion of the swash plate to the reciprocal linear motion of each piston.

In the conventional compressor, an electromagnetic clutch is provided between an external driving source, such as the vehicle's engine, and the rotary shaft of the compressor. Power transmission from the driving source to the rotary shaft is controlled by the ON/OFF action of this clutch. At the time the electromagnetic clutch is activated or deactivated, the clutch's action generates a shock generally detrimental not only to the compressor but also the overall driving comfort experienced by the vehicle's passengers. In addition, the integration of the clutch with the compressor increases the overall weight of the compressor.

The solve the above shortcomings, Japanese Unexamined Patent Publication No. 63-183277 discloses a variable displacement swash plate type compressor which does not employ an electromagnetic clutch for transmitting power from the external driving source to the compressor.

In this compressor, a pair of bearing members support a rotary shaft having a pulley secured thereto for power transmission from an external driving source. One of the bearing members is provided in a cylinder block while the other bearing member is provided in the housing which defines a crank chamber. The stable support of the rotary shaft results in the reduction of the vibration and noise of the compressor. This is achieved by increasing the distance between the bearing members. According to the structure in which the rotary shaft is supported in the housing, however, the distance between the bearing members cannot be increased unless the entire length of the compressor is increased.

SUMMARY OF THE INVENTION

It is an object of the present invention to provide a shaft supporting structure for a compressor that enhance the stable support of the rotary shaft in order to suppress vibration and noise without having to enlarge the size of the compressor.

To achieve the foregoing objects, according to the invention, a compressor is provided wherein a rotary drive shaft having a first end and a second end, both the ends being rotatably supported by opposing walls of a crank chamber defined in a casing and a swash plate tiltably mounted on the drive shaft and operably coupled with a piston in a cylinder bore. A rotation of the drive shaft results in a reciprocating movement of the piston for compressing refrigerant gas in a cylinder bore. A rotary member is secured to the first end which extends outside the casing. The rotary member supplies a power to the drive shaft from a power supply. A support member, disposed between the rotary member and the first end, protrudes outward from the casing. A first bearing, disposed between the support member and the rotary member, receives a thrust load and a radial load acting on the rotary member when the rotary member rotates. A second bearing, disposed between the casing and the second end, receives the radial load acting on the rotary member when the rotary member rotates.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DESCRIPTION OF THE PREFERRED EMBODIMENT

A compressor according to a first embodiment of the present invention for use in an air conditioning system will now be described referring to FIGS. 1 through 6. The compressor as described operates without a clutch between the external driving source and the compressor.

Figure 1:
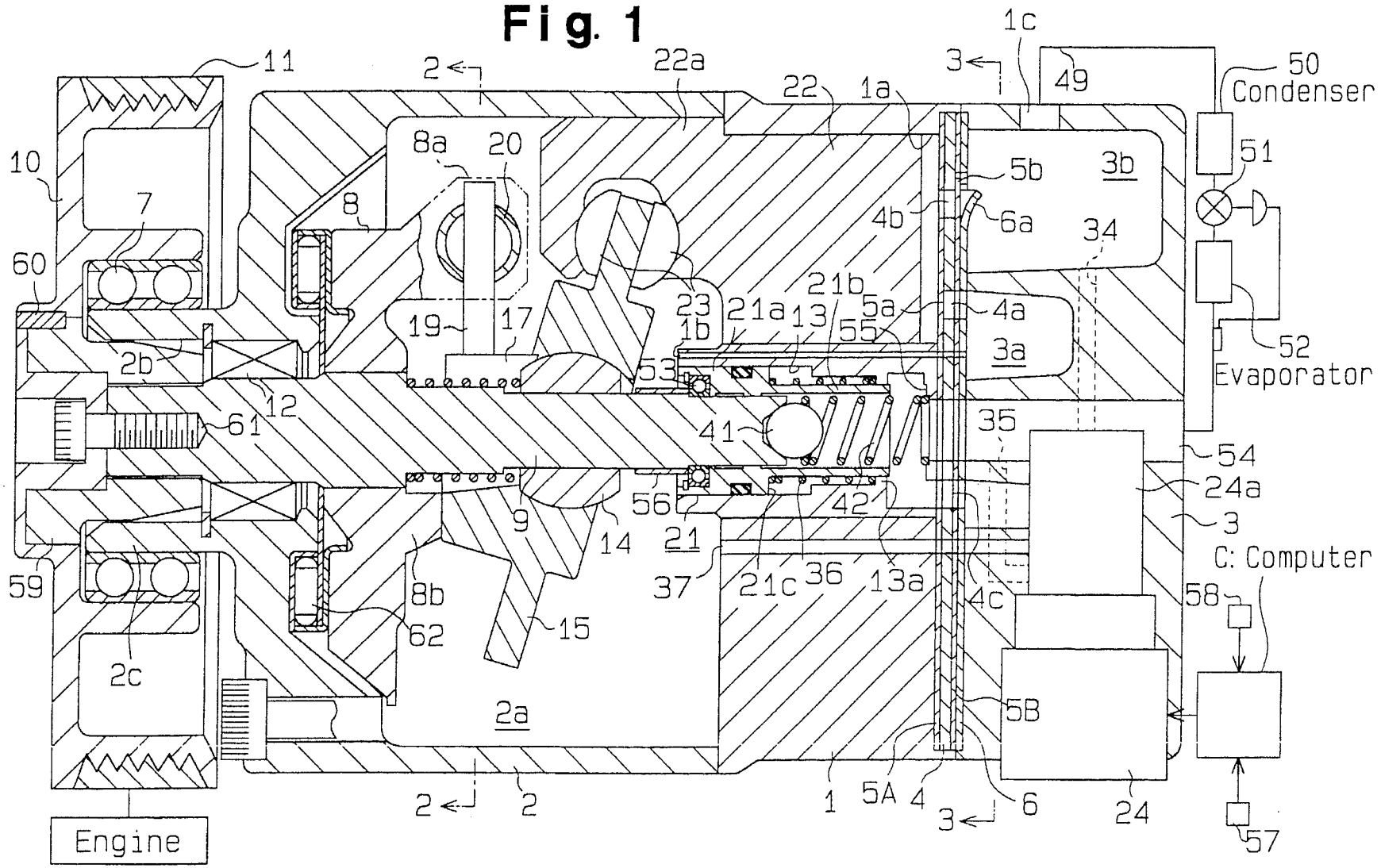
FIG. 1 is a cross-sectional side view of an entire compressor according to an embodiment of the present invention.

As shown in FIG. 1, a front housing 2 is connected to the front end of a cylinder block 1. A rear housing 3 is securely connected to the rear end of the cylinder block 1 via a valve plate 4, valve forming plates 5A and 5B and a retainer forming plate 6. The front housing 2, cylinder block 1 and rear housing 3 constitute a casing of the compressor. The front housing 2 and the cylinder block 1 define a crank chamber 2*a*.

A rotary shaft 9 is rotatably supported between the front housing 2 and the cylinder block 1. The front end of the rotary shaft 9 protrudes outside from the crank chamber 2*a* through an opening 2*b* of the front housing 2. A cylindrical holder 59 is securely fastened on this protruding end portion. A pulley 10 is fitted on the holder 59, with a key 60 intervening between the pulley 10 and the holder 59. The key 60 inhibits the relative rotation between the pulley 10 and the holder 59.

The pulley 10, attached to the rotary shaft 9 by a screw 61, rotates when coupled to a vehicle's running engine via a belt 11. The pulley 10 rotates in the direction in which the holder 59 is fastened to the rotary shaft 9 by the screw 61. Therefore, the pulley 10 and rotary shaft 9 rotate together, in one direction.

A support cylinder 2*c* protrudes from the front end of the front housing 2 and surrounds the front end portion of the rotary shaft 9. The driven pulley 10 is rotatably supported by the support cylinder 2*c* via an angular contact ball bearing 7 which serves as a first bearing member. The support cylinder 2*c* receives both the thrust load acting on the pulley 10 and the radial load via the angular bearing 7.

A lip seal 12, positioned between the support cylinder 2*c* and rotary shaft 9 proximate to the front opening 2*b*, prevents gas from leaking from inside the crank chamber to the outside along the rotary shaft 9.

Figure 2:
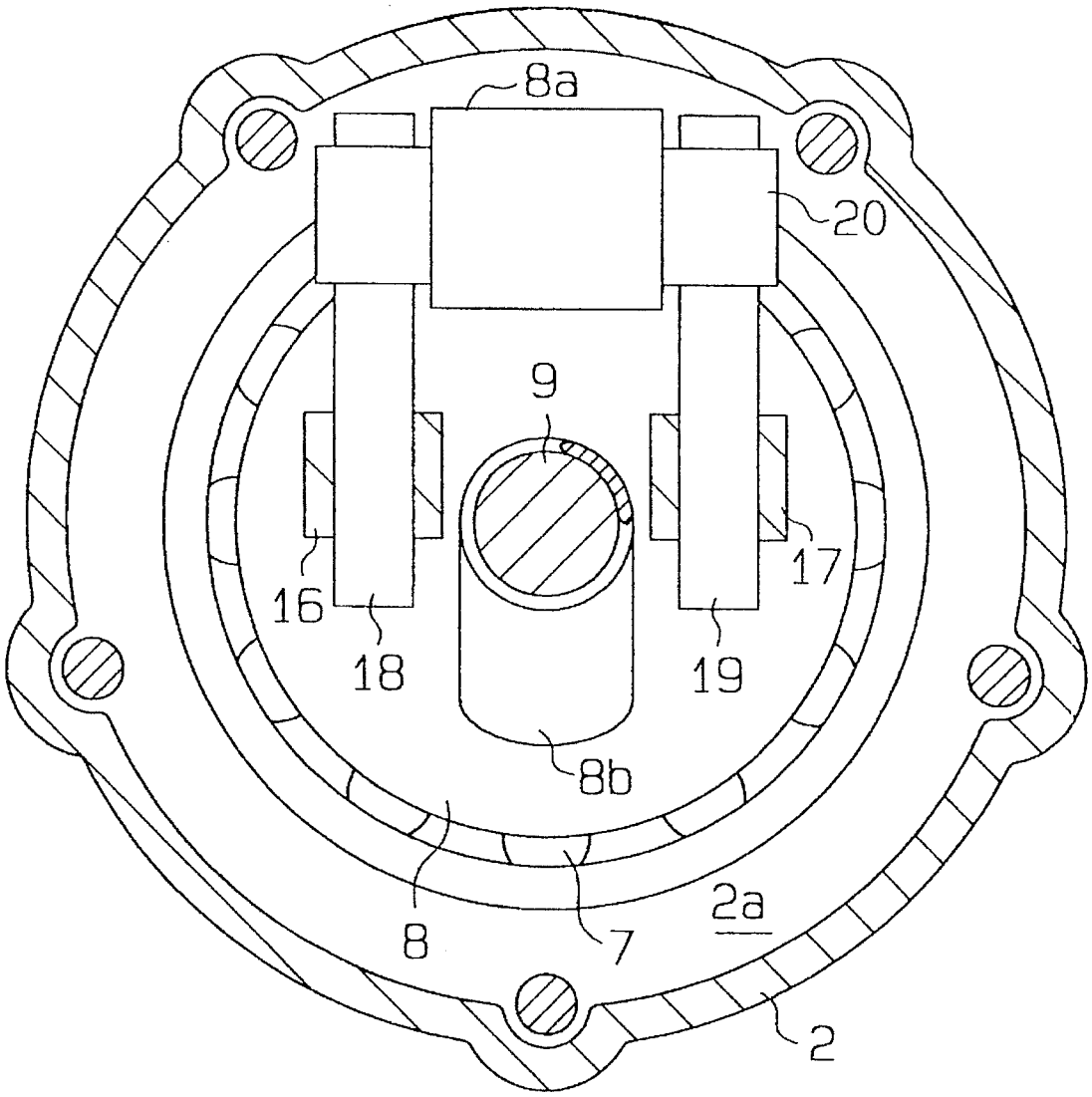
FIG. 2 is a cross-sectional view along the line 2—2 in FIG. 1.

A drive plate 8 is secured on the rotary shaft 9, and a spherical slider 14 is slidably supported on the rotary shaft 9. A swash plate 15 is supported on the slider 14 in such a way as to be slidable in the axial direction of the rotary shaft 9. Link pieces 16 and 17 are secured to the swash plate 15. A pair of guide pins 18 and 19 are secured to the link pieces 16 and 17 as shown in FIG. 2. A support arm 8*a* protrudes from the drive plate 8.

A support pin 20 is rotatably supported in the support arm 8*a*, and extends perpendicular to the rotary shaft 9. The pair of guide pins 18 and 19 are slidably fitted in the respective end portions of the support pin 20. The interlocked action of the support pin 20 and the guide pins 18 and 19 permits the swash plate 15 not only to rock forward and backward along the axial direction of the rotary shaft 9 around the slider 14, but to rotate together with the rotary shaft 9.

Figure 4:
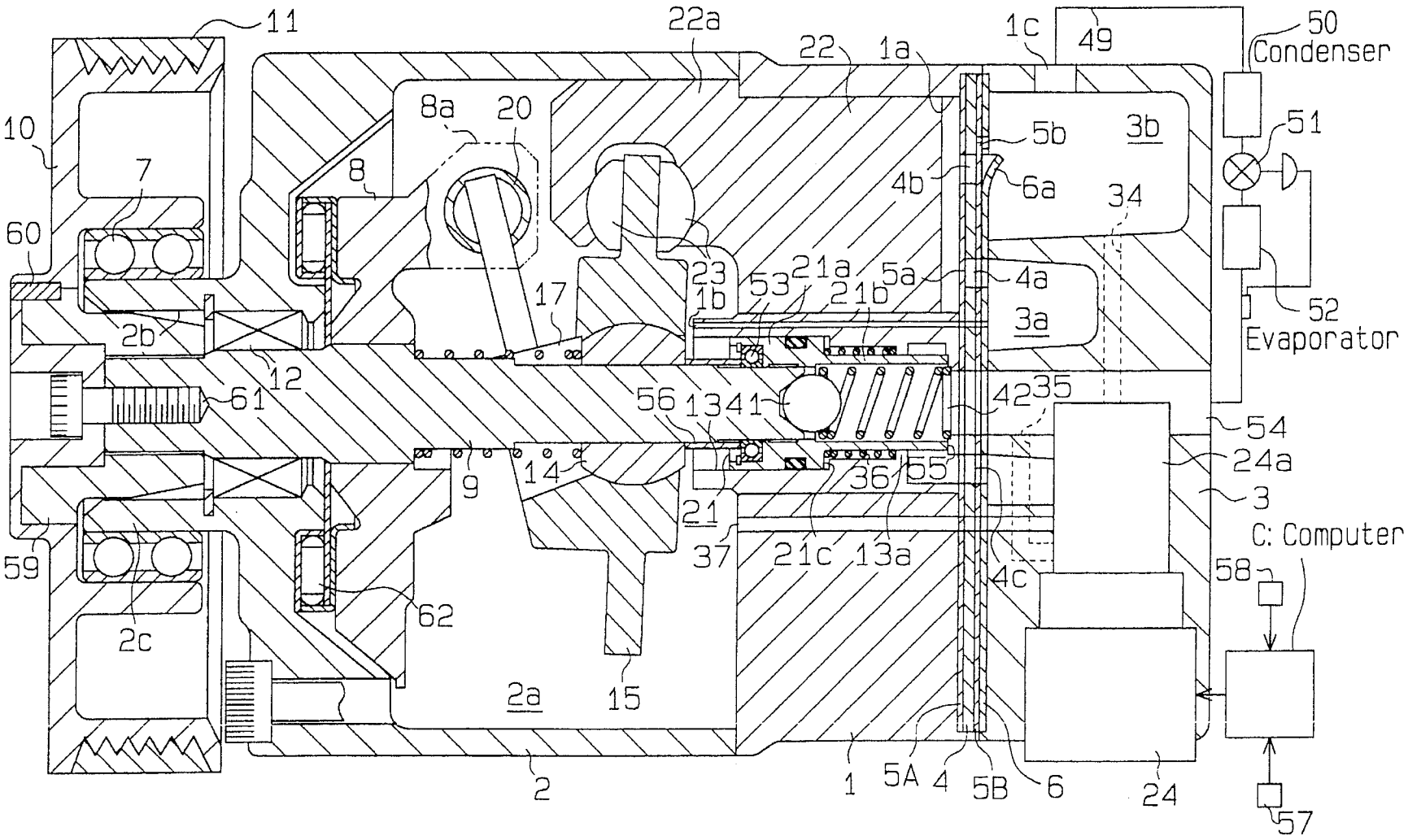
FIG. 4 is a cross-sectional side view showing a swash plate at the minimum inclined angle.
Figure 5:
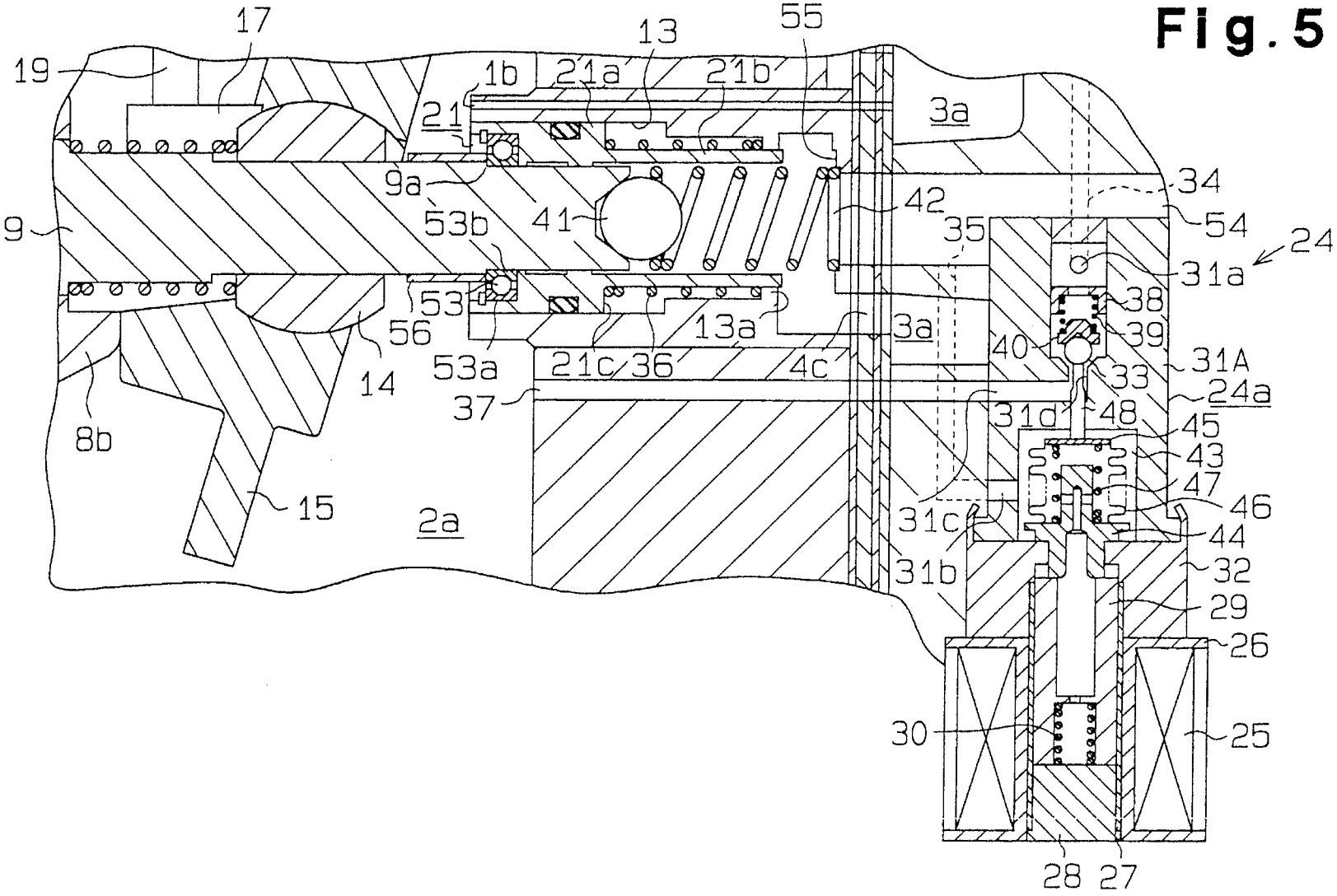
FIG. 5 is a partially enlarged cross-sectional view of the compressor, showing a blocking body at an opening position.

A cylindrical space 13 is defined in the center portion of the cylinder block 1 in the axial direction of the rotary shaft 9. A movable cylinder 21 is slidably retained in the space 13, as shown in FIGS. 1, 4 and 5. The movable cylinder 21 has a large-diameter portion 21*a* and a small-diameter portion 21*b*. A spring 36 is interposed between a step portion 21*c* at the outer surface of the movable cylinder 21 and a flange portion 13*a* on the inner wall of the space 13. The spring 36 urges the movable cylinder 21 toward the slider 14.

The rear end portion of the rotary shaft 9 is fitted in the large-diameter portion 21*a* of the movable cylinder 21. A ball 41 is pressed against the rear end surface of the rotary shaft 9 by a spring 42. The spring 42 serves to suppress the displacement of the rotary shaft 9 in the thrust direction.

A ball bearing 53 intervenes between the rear end portion of the rotary shaft 9 and the large-diameter portion 21*a* of the movable cylinder 21, as shown in FIG. 5. The rear end portion of the rotary shaft 9 is supported by the inner wall of the space 13 via the ball bearing 53 and the movable cylinder 21. The ball bearing 53 has both an outer ring 53*a* secured to the inner surface of the large-diameter portion 21*a* and an inner ring 53*b* which is slidable on the surface of the rotary shaft 9.

As shown in FIG. 5, a step portion 9*a* is formed in the outer peripheral surface of the rear end portion of the rotary shaft 9, so that the movement of the inner ring 53*b* toward the slider 14 is restricted by the step portion 9*a*. Accordingly, when the ball bearing 53 abuts on the step portion 9*a*, the movement of the movable cylinder 21 toward the slider 14 is inhibited.

A suction passage 54 is formed in the center portion of the rear housing 3 as shown in FIGS. 1 and 5. The suction passage 54 is connected to the space 13. A positioning surface 55 is formed around the opening of the suction passage 54 on the side of the space 13. When the rear end surface of the small-diameter portion 21*b* of the movable cylinder 21 abuts against the positioning surface 55, the backward movement of the movable cylinder 21 is restricted and the communication between the suction passage 54 and the space 13 is blocked.

A transmission cylinder 56 is slidably provided on the rotary shaft 9 between the slider 14 and the ball bearing 53. The transmission cylinder 56 has both a front end which can abut against the rear end surface of the slider 14 and a rear end that abuts against the inner ring 53*b* of the ball bearing 53.

As the slider 14 moves in a backward direction toward the movable cylinder 21, the movable cylinder 21 abuts the transmission cylinder 56, pressing it against the inner ring 53*b* of the ball bearing 53. The ball bearing 53 receives the load in the thrust direction as well as the load in the radial direction. Accordingly, the movable cylinder 21 is urged toward the positioning surface 55 against the force of the spring 36, so that the rear end surface of the small-diameter portion 21*b* abuts on the positioning surface 55. The swash plate's inclined angle can thus be changed to a minimum value, i.e. slightly larger than zero degrees, as shown in FIG. 4.

This occurs when the movable cylinder 21 comes to a closing position to block the communication between the suction passage 54 and the space 13. The movable cylinder 21 moves between the closing and opening positions, in response to the slider 14. It should be noted that the maximum inclined angle of the swash plate 15 is restricted by the abutment of a projection 8*b* of the drive plate 8 on the swash plate 15.

Single-head pistons 22 are retained in cylinder bores 1*a*, formed through the cylinder block 1 so as to connect to the crank chamber 2*a*. A pair of shoes 23 are slidably fitted over a neck 22*a* of the piston 22. The peripheral portion of the swash plate 15 is inserted between a pair of shoes 23 so that the end faces of both shoes 23 are in contact with both surfaces of the swash plate 15. Accordingly, the rotational motion of the swash plate 15 is converted to the reciprocal motion of the piston 22 via the shoes 23, causing the piston 22 to reciprocate in the associated cylinder bore 1*a*.

Figure 3:
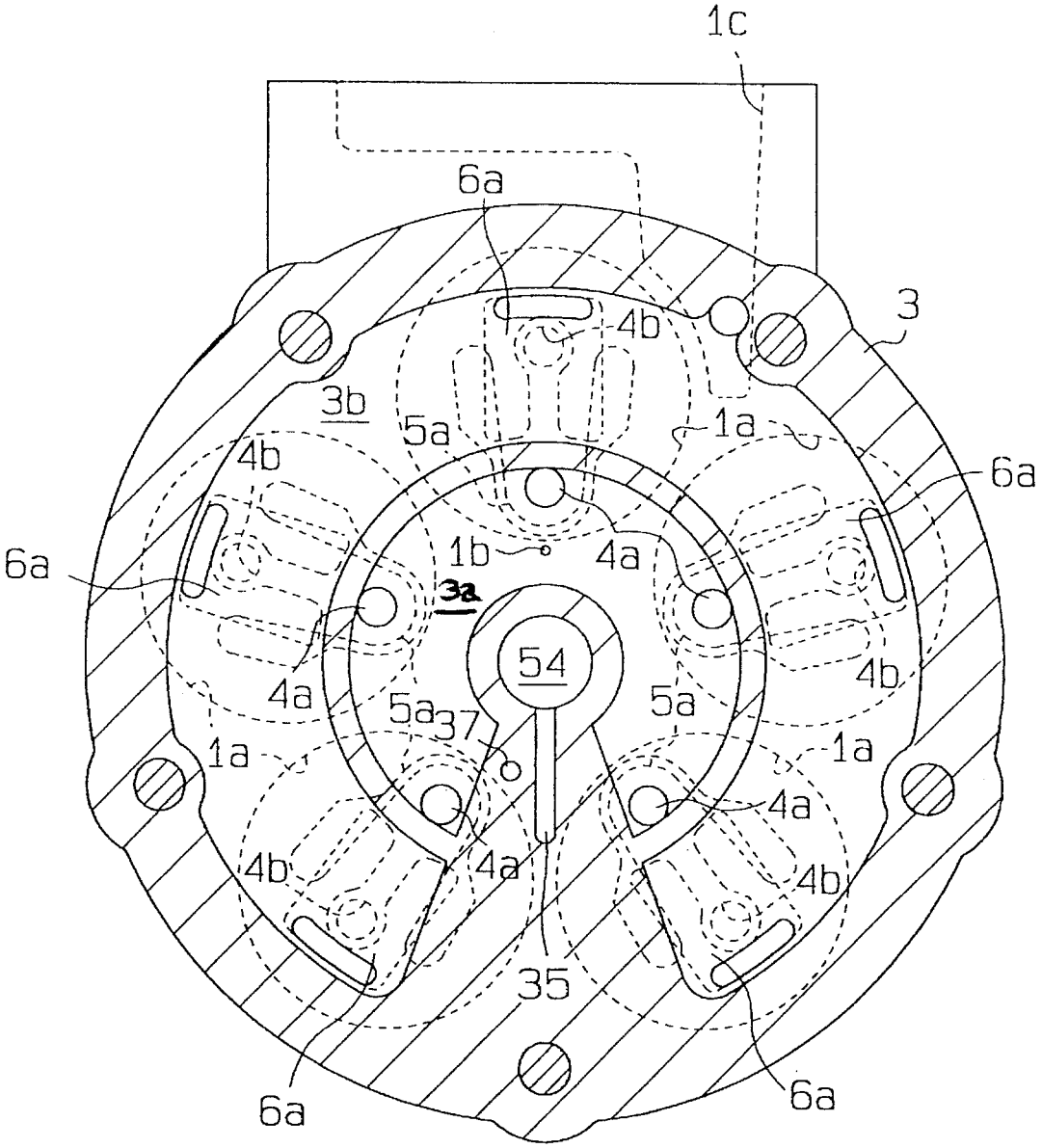
FIG. 3 is a cross-sectional view along the line 3—3 in FIG. 1.

As shown in FIGS. 1 and 3, a suction chamber 3*a* and a discharge chamber 3*b* are defined in the rear housing 3. A suction port 4*a* and a discharge port 4*b* are formed on the valve plate 4. Suction valves 5*a* and 5*b* are formed on the valve forming plates 5A and 5B respectively. The backward returning action of each piston 22 allows the refrigerant gas in the suction chamber 3*a* to push the suction valve 5*a* open, and to enter each cylinder bore 1*a* via its corresponding suction port 4*a*.

When each piston 22 moves forward, the refrigerant gas that has entered each cylinder bore 1*a* pushes each discharge valve 5*b* to open and is then discharged into the discharge chamber 3*b* through each discharge port 4*b*. Each discharge valve 5*b* abuts against each retainer 6*a* on the retainer forming plate 6 so that the opening of the valve 5*b* is restricted.

A thrust bearing 62 intervenes between the drive plate 8 and the front inner wall of the front housing 2. The thrust bearing 62 receives a reactive force due to the compressed gas which acts on the drive plate 8 via the pistons 22, shoes 23, swash plate 15, link pieces 16 and 17, guide pins 18 and 19 and support pin 20 in accordance with the reciprocation of the pistons 22.

The stroke of each piston 22 changes in accordance with the difference between the pressure in the crank chamber 2*a* and the suction pressure in the cylinder bore 1*a*. Thus, the inclined angle of the swash plate 15, which affects the compression displacement, varies. The pressure in the crank chamber 2*a* is controlled by a displacement control valve 24 that is attached to the rear housing 3. The crank chamber 2*a* is connected to the suction chamber 3*a* via a pressure release passage 1*b* that serves as a restriction to the flow of gas from the suction chamber 3*a* to the crank chamber 2*a*.

The suction chamber 3*a* communicates with the space 13 via a port 4*c* that is formed through each plate 4, 5 and 6. When the movable cylinder 21 moves to the closing position, the port 4*c* is shut off from the suction passage 54. It should be noted that the suction passage 54 is an inlet port through which refrigerant gas is supplied into the compressor. The movable cylinder 21 may shut off the communication between the suction passage 54 and the suction chamber 3*a* at the downstream portion of the suction passage 54.

The internal structure of the displacement control valve 24 will be described with reference to FIGS. 5 and 6.

A bobbin 26 of the valve 24 supports a solenoid 25 on the outer periphery thereof. A guide cylinder 27 is fixed to the hollow portion of a bobbin 26. A fixed core 28 is securely retained in the guide cylinder 27. A movable core 29 is retained in the guide cylinder 27 in such a way that it moves to and away from the fixed core 28. A spring 30 is disposed between the fixed core 28 and the movable core 29. The movable core 29 is urged away from the fixed core 28 by the spring 30.

A valve housing 31 is securely coupled to the bobbin 26 via a connecter 32. A spherical valve 33 is disposed in the valve housing 31. A first inlet port 31*a* for introducing the discharge pressure therein, a second inlet port 31*b* for introducing the suction pressure therein and a control port 31*c* are formed in the valve housing 31. The first inlet port 31*a* communicates with the discharge chamber 3*b* via a first passage 34. The second inlet port 31*b* communicates with the suction passage 54 via a second passage 35, and the control port 31*c* communicates with the crank chamber 2*a* via a control passage 37.

A return spring 39 and a valve seat 40 are disposed between a spring seat 38 and the valve 33 in the valve housing 31. The valve 33 receives the force of the return spring 39 acting in the direction to close a valve hole 31*d*.

A metal fitting 44 secured to the movable core 29 is retained in a suction-pressure sensing chamber 43, which communicates with the second inlet port 31*b*. The metal fitting 44 is coupled to a spring seat 45 by a bellows 46. A spring 47 intervenes between the metal fitting 44 and the spring seat 45. A rod 48 is secured to the spring seat 45, with its distal end abutting on the valve 33. The valve 33 opens or closes the valve hole 31*d* in accordance with a change in suction pressure in the chamber 43. When the valve hole 31*d* is closed, the communication between the first inlet port 31*a* and the control port 31*c* is blocked.

An outlet port 1*c* discharges the refrigerant gas from the discharge chamber 3*b* into an external refrigerant circuit 49, as shown in FIG. 1. The outlet port 1*c* is connected to the suction passage 54 by the external refrigerant circuit 49. Provided on the external refrigerant circuit 49 are a condenser 50, an expansion valve 51 and an evaporator 52. The expansion valve 51 controls the amount of the refrigerant gas allowed in the circuit 49 in accordance with a change in gas pressure on the outlet side of the evaporator 52.

A computer C controls the solenoid 25. The computer C energizes the solenoid 25 in accordance with the ON action of the vehicle's air-conditioner switch 57 or the OFF action of the vehicle's accelerator switch 58. The computer C also de-energizes the solenoid 25 in accordance with the OFF action of the switch 57 or the ON action of the switch 58. FIG. 5 shows a state where the solenoid 25 is excited. With the solenoid 25 excited, the movable core 29 is attracted to the fixed core 28 against the force of the spring 30, as shown in FIG. 5.

With the solenoid 25 excited, the bellows 46 is displaced by an amount corresponding to the variation in suction pressure in the suction passage 54. This displacement is transmitted to the valve 33 via the rod 48. When the suction pressure is high, i.e. when cooling load is large, the opening of the valve 33 is reduced. This causes the amount of the refrigerant gas, which flows into the crank chamber 2*a* from the discharge chamber 3*b* via the passage 34, the first inlet port 31*a*, the valve hole 31*d*, the control port 31*c* and the control passage 37, to be reduced. The refrigerant gas in the crank chamber 2*a* flows to the suction chamber 3*a* via the pressure release passage 1*b*. This consequently reduces the pressure in the crank chamber 2*a*. On the other hand, when the suction pressure in the cylinder bore 1*a* is high, the difference between the pressure in the crank chamber 2*a* and the suction pressure in the cylinder bore 1*a* decreases. This causes the inclined angle of the swash plate 15 to increase as shown in FIGS. 1 and 5.

When the suction pressure is low, i.e. when cooling load is small, on the other hand, the opening of the valve 33 increases. This causes an increase in the amount of the refrigerant gas flowing into the crank chamber 2*a* from the discharge chamber 3*b*, which increases the pressure in the crank chamber 2*a*. When the suction pressure in the cylinder bore 1*a* is low, the difference between the pressure in the crank chamber 2*a* and the suction pressure in the cylinder bore 1*a* increases. This consequently reduces the inclined angle of the swash plate.

When the suction pressure is extremely low, i.e. when no cooling load is applied to the compressor, the opening of valve 33 approaches the maximum. With the solenoid 25 de-energized, in accordance with the OFF action of the switch 57 or the ON action of the accelerator switch 58, the movable core 29 moves away from the fixed core 28 due to the force of the spring 30. This changes the opening of the valve 33 to a maximum, as shown in FIG. 6. Under these circumstances, the refrigerant gas in the discharge chamber 3*b* undergoes a rapid flows into the crank chamber 2*a*. The consequent increase in the crank chamber's pressure quickly rises to a maximum, thus changing the inclined angle of the swash plate 15 to a minimum.

With a reduced inclined angle of the swash plate 15, the slider 14 shifts toward the movable cylinder 21 and abuts on the transfer cylinder 56. The transfer cylinder 56 pushes the inner ring 53*b* of the ball bearing 53 backward. Thus, the transfer cylinder 56 is held between the slider 14 and the inner ring 53*b*. The transfer cylinder 56 therefore can rotate together with the rotary shaft 9. Due to the fact the transfer cylinder 56 abuts only on the inner ring 53*b* of the ball bearing 53, the rotary shaft 9, rotates together with the slider 14, the transfer cylinder 56 and the inner ring 53*b*. No sliding motion occurs between the slider 14, the transfer cylinder 56 and the inner ring 53*b*.

When the transfer cylinder 56, pressed against the ball bearing 53, further moves toward the movable cylinder 21, the movable cylinder 21 is pushed toward the positioning surface 55 so that the distal end of the small-diameter portion 21*b* of the movable cylinder 21 approaches the positioning surface 55. This design effects a gradual decline in the area through which the refrigerant gas passes, i.e., from the suction passage 54 to the suction chamber 3*a*. Accordingly, the amount of the refrigerant gas supplied into the cylinder bore 1*a* from the suction chamber 3*a* also decreases gradually, slowly reducing the discharge displacement or discharge pressure. This prevents large changes in the compressor's torque over short periods of time.

When the movable cylinder 21 abuts on the positioning surface 55, the flow of the refrigerant gas from the external refrigerant circuit 49 to the suction chamber 3*a* stops. When the minimum inclined angle of the swash plate is other than at zero degrees, the gas is still discharged into the discharge chamber 3*b* from the cylinder bore 1*a*, effected even with the minimum inclined angle of the swash plate. The gas discharged into the discharge chamber 3*b* flows into the crank chamber 2*a* via the first passage 34, the control valve 24 and the control passage 37. The refrigerant gas in the crank chamber 2*a* flows into the suction chamber 3*a* via the pressure release passage 1*b*, and the refrigerant gas in the suction chamber 3*a* is fed into the cylinder bore 1*a* to be discharged into the discharge chamber 3*b*. At this time, it is apparent that there are pressure differences among the pressures in the discharge chamber 3*b*, the crank chamber 2*a* and the suction chamber 3*a*. The refrigerant gas in the compressor avoids flowing to the external refrigerant circuit 49, preventing frosting in the evaporator 52.

Figure 6:
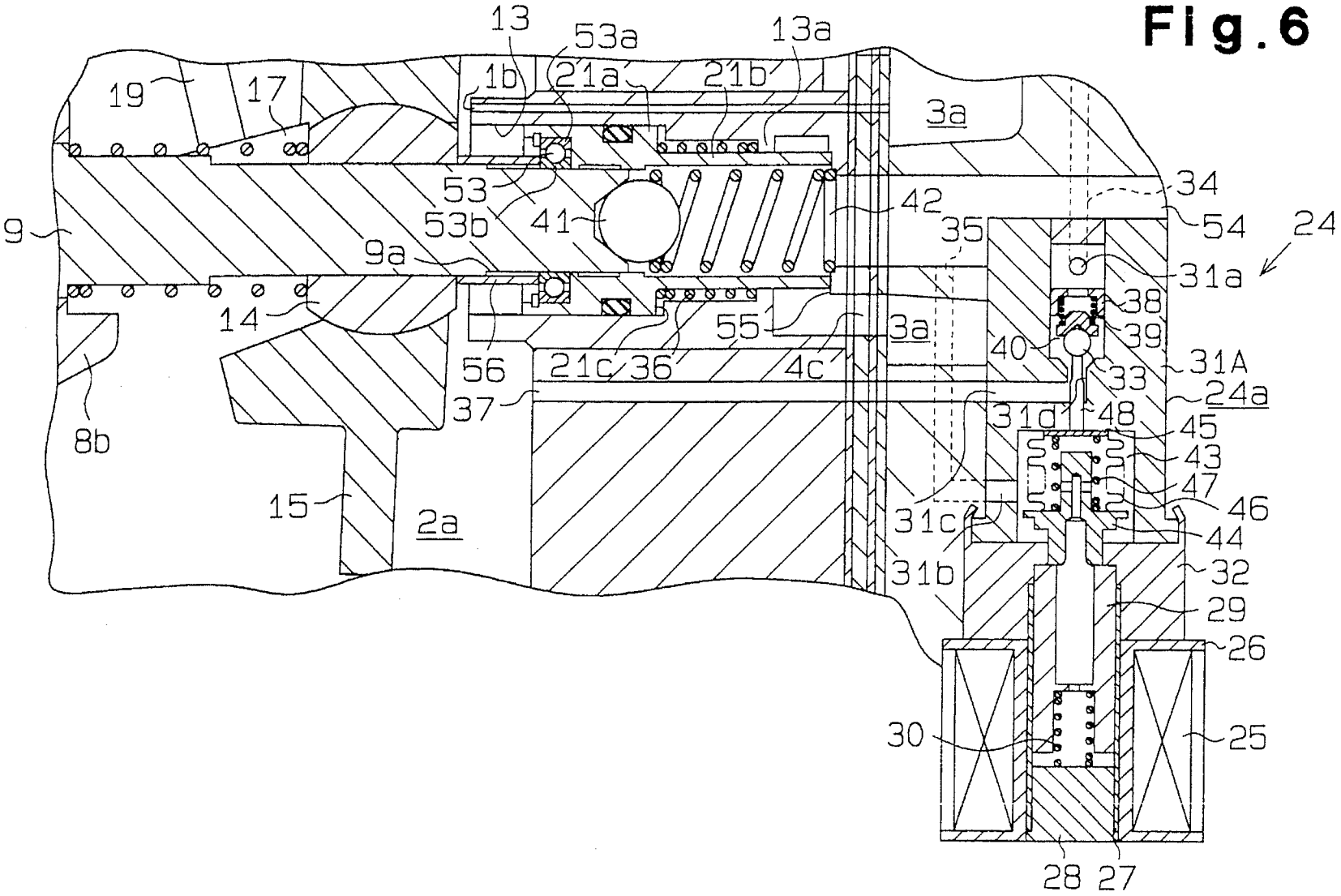
FIG. 6 is a partially enlarged cross-sectional view of the compressor, showing the blocking body at a closing position and a solenoid in a de-excited state.

When the switch 57 turns on or when the accelerator switch 58 turns off in the state shown in FIG. 6, the solenoid 25 is energized. This causes the movable core 29 to be attracted to the fixed core 28. Then, the bellows 46 contracts due to the suction pressure in the chamber 43, and the valve 33 closes the valve hole 31*d*.

When there are pressure differences among the pressures in the discharge chamber 3*b*, the crank chamber 2*a* and the suction chamber 3*a*, and when the valve 33 closes the valve hole 31*d*, the pressure in the crank chamber 2*a* decreases. This causes an increase to the inclined angle of the swash plate. This increase in the inclined angle causes the slider 14 to move away from the movable cylinder 21.

The movable cylinder 21 follows the movement of the slider 14 due to the force of the spring 36, so that the distal end of the small-diameter portion 21*b* is separated from the positioning surface 55. This gradually increases the area through which the refrigerant gas passes, i.e., from the suction passage 54 to the suction chamber 3*a*. As a result the amount of the refrigerant gas flowing into the suction chamber 3*a* from the suction passage 54 increases slowly.

Accordingly, the amount of the refrigerant gas flowing into the cylinder bore 1*a* from the suction chamber 3*a* gradually increases, thus resulting in a slow increase in discharge displacement. As a result, the discharge pressure rises slowly, so that the torque in the compressor does not change greatly in a short period of time.

The rotary shaft 9 keeps rotating unless the external driving source stops. Stable support of the rotary shaft 9 is important to suppress the vibration and noise of the compressor. To ensure the stable support of the rotary shaft 9, first, it is essential to increase the distance between the support positions of the pair of bearing members. According to this embodiment, the angular bearing 7, which serves the first bearing member, is arranged in front of the front housing 2. The ball bearing 53, which serves the second bearing member, is located in the space 13 in the cylinder block 1. This arrangement sets the distance between both bearings 7, 53 greater than the distance in the prior art without increasing the entire length of the compressor.

As previously described, according to the conventional structure, the first bearing member is located within the front housing 2. The distance between the first bearing member and the second bearing member cannot be increased unless the length of the front housing 2 is increased.

With the structure having the angular bearing 7 on the support cylinder 2*c* according to this embodiment, however, the length of the support cylinder 2*c* is substantially the same as the length of a portion of the rotary shaft 9 which protrudes from the front housing. It should be noted that this length is necessary to connect the pulley 10 to the rotary shaft 9 like in the prior art. Therefore, the distance between the angular bearing 7 and the ball bearing 53 becomes greater than the conventional one without increasing the length of the front housing 2. This ensures a more stable support of the rotary shaft 9 than that provided by the prior art.

The radial load from the external driving source acting onto the pulley 10 via the belt 11 is entirely received by the support cylinder 2*c*. The thrust load acting on the pulley 10 is also received by the support cylinder 2*c*. Consequently, the pulley 10 is supported with enhanced stability. The rotary shaft secured to the pulley 10 is also supported by the angular bearing 7 with increased stability.

The smoothness in the sliding motion of the movable cylinder 21 may inhibit a rapid torque change in the compressor. The smoothness necessitates the stable support of the rotary shaft 9. In an unstable supporting state the rotary shaft 9 vibrates, and the sliding motion of the movable cylinder 21 lacks smoothness. This makes it difficult to gradually change the flow of the supplied refrigerant gas. According to this embodiment, however, the rotary shaft 9 has stable support allowing the movable cylinder 21 to slide with a smooth movement.

The entire radial load applied to the driven pulley 10 via the belt 11 from the external driving source is received by the support cylinder 2*c*. The radial load is not applied to the rotary shaft 9. This produces the following advantages.

In the conventional clutchless compressor, the refrigerant gas normally distributes lubricant oil to the individual bearing members supporting the rotary shaft inside the compressor. The lip seal is usually located in front of the front bearing member in order to prevent gas in the crank chamber from leaking along the rotary shaft to the outside. Such a lip seal necessitates increasing the length of the rotary shaft protruding from the front housing. Consequently, when a load applied to the pulley, a bending moment occurs on the rotary shaft with the front bearing member serving as a fulcrum point.

Usually the rotary shaft in the conventional compressor should be strong enough to endure the moment at least from the position where the front bearing member is located to the position where the pulley is secured. This typically necessitates increasing the diameter of the rotary shaft. Unfortunately, increasing the rotor's diameter causes an increase in the slide contact area between the lip seal and the rotary shaft. Since the lip seal is usually pressed against the rotary shaft by the pressure in the crank chamber, the increase in the slide contact area increases the sliding resistance between the rotary shaft and the lip seal. This contributes to a power loss and quickens the deterioration of the lip seal. Moreover, the increased diameter of the rotary shaft increases the peripheral velocity of the rotary shaft, further hastening the deterioration of the lip seal.

In the present invention, however, the radial load, applied to the pulley 10 from the external driving source, is entirely received by the support cylinder 2*c*. The diameter of the rotary shaft 9 can be made smaller as compared with the conventional compressor, thus reducing the slide contact area of the lip seal 12 and the rotary shaft 9. The decreased sliding area reduces sliding resistance between the rotary shaft 9 and the lip seal 12, which in turn reduces the compressor's power loss and improves the durability of the lip seal 12. The reduced diameter of the rotary shaft decreases the peripheral velocity of the rotary shaft 9, further improving the durability of the lip seal 12.

Figure 7:
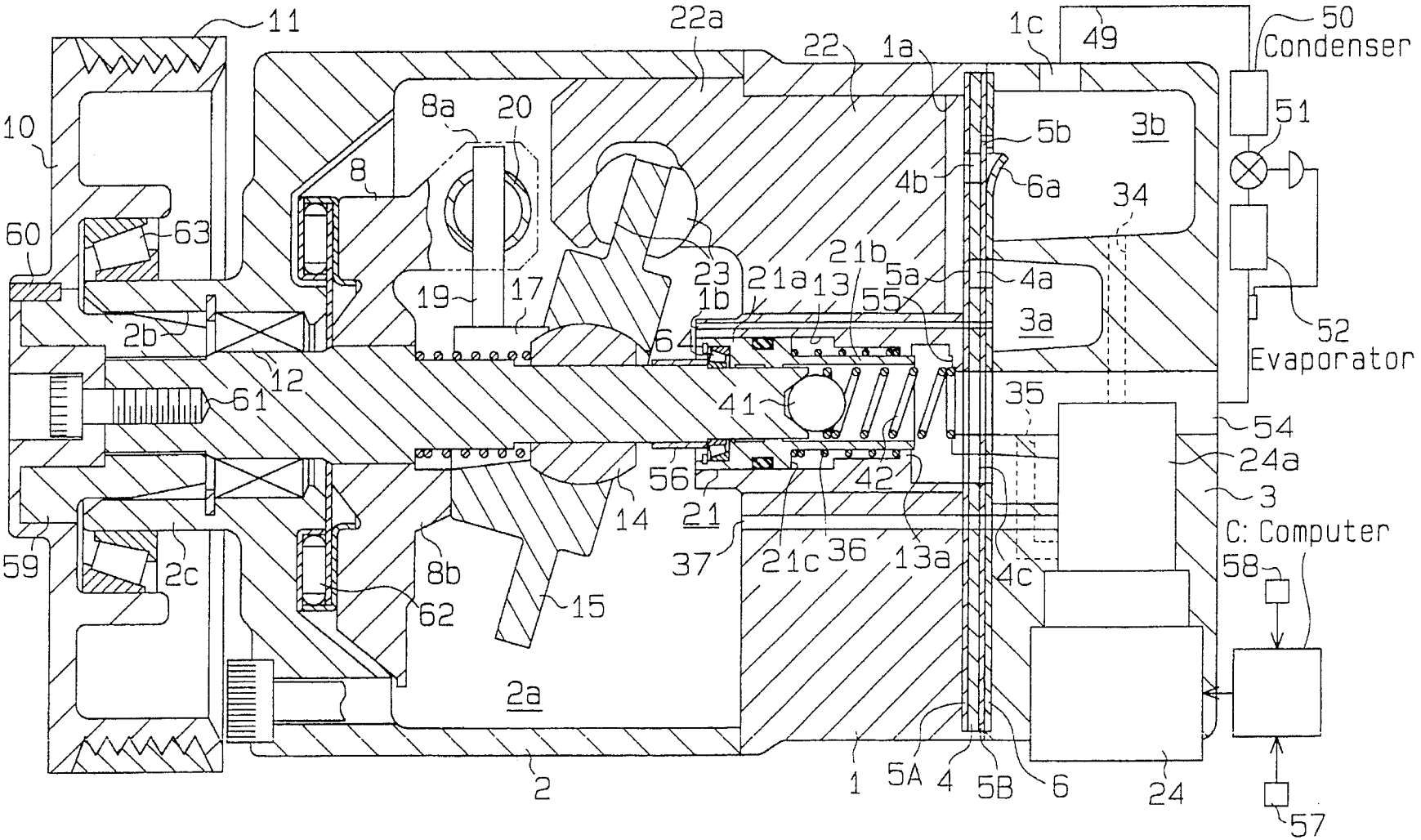
FIG. 7 is a cross-sectional side view of an entire compressor according to another embodiment.

The present invention is not of course limited to the above described embodiment, and conical roller bearings 63 and 64 may be used as the first and second bearings as shown, for example, in FIG. 7. The bearing 63 receives the thrust load which acts on the pulley 10 in the direction toward the cylinder block 1 from the front housing 2. The thrust load which acts on the pulley 10 in the direction toward the front housing 2 from the cylinder block 1 is received by a thrust bearing 62 in the front housing 2. The conical roller bearing 64 exhibits the same function as the ball bearing 53 in the above described embodiment.

Although the above described embodiments are directed to a clutchless compressor, the present invention can be applied to a clutchless compressor having no mechanism to prevent refrigerant gas from entering into the compressor from the external refrigerant circuit. Japanese Unexamined Patent Publication No. 63-183277 discloses such a clutchless type compressor. The compressor according to the '277 publication discloses a radial bearing used for the second bearing member to support the rotary shaft in the compressor.

The present examples and embodiments are to be considered as illustrative and not restrictive and the invention is not to be limited to the details given herein, but may be modified within the scope of the appended claims.

What is claimed is:

1. A compressor comprising a rotary drive shaft having a first end and second end, said first and second ends being rotatably supported by opposing walls of a crank chamber defined in a casing, a disk tiltably mounted on said drive shaft and operably coupled to a plurality of pistons, such that rotation of said drive shaft results in reciprocating movement of said pistons for compressing refrigerant gas in a corresponding plurality of cylinder bores;

said first end of said drive shaft extending outside said casing;

a rotary member continuously coupled to said first end of said drive shaft for directly driving said drive shaft from a driving source;

a rigid support member protruding outwardly from said casing and disposed between said rotary member and said first end of said drive shaft;

a first bearing disposed between said rigid support member and said rotary member for receiving a thrust load and a radial load acting on said rotary member when said rotary member is rotatably driven by said driving source; and a second bearing disposed between said second end of said drive shaft and the adjacent one of said walls of said crank chamber for receiving a radial load acting on said rotary member when said rotary member is rotated; and said drive shaft being rotatably supported by only said first and second bearings.

2. A compressor according to claim 1, wherein said first bearing includes an angular contact ball bearing.

3. A compressor according to claim 1, wherein said second bearing comprises a cylinder slidably mounted on said second end of said drive shaft and reciprocatable along said drive shaft within a predetermined range; and said compressor further comprising urging means for urging said cylinder toward said disk to move said cylinder to an extent based on the inclined angle of said disk.

4. A compressor according to claim 3, wherein said second bearing further comprises:

a ball bearing disposed between said cylinder and said second end of said drive shaft;

a ball engageable with said second end of said drive shaft; and a spring disposed between said casing and said second end of said drive shaft for urging said ball in the direction counter to said thrust load.

5. A compressor according to claim 3, wherein said casing includes:

a cylinder block having a front section and a rear section;

a front housing secured to said front section of said cylinder block;

a rear housing secured to said rear section of said cylinder block; and wherein said crank chamber is defined by said front housing and said cylinder block.

6. A compressor according to claim 5, wherein said support member is formed integrally with said front housing.

7. A compressor according to claim 6, further comprising a center portion and a peripheral portion formed with said rear housing, said center portion having a suction chamber and a suction passage for sucking the refrigerant gas into said suction chamber; and said peripheral portion having a discharge chamber; wherein said cylinder block defines a space for communicating said suction chamber with said suction passage and for accommodating said cylinder, wherein said cylinder selectively opens and closes said suction passage in accordance with said reciprocal movement of said cylinder.

8. A compressor according to claim 7, wherein said rear housing has a valve for controlling the pressure of the refrigerant gas in said crank chamber in response to the pressure of refrigerant gas in said suction passage.

9. A compressor comprising a rotary drive shaft having a first end and a second end, said first and second ends being rotatably supported by opposing walls of a crank chamber defined in a casing, a disk tiltably mounted on said drive shaft and operably coupled to a plurality of pistons, such that rotation of said drive shaft results in reciprocating movement of said pistons for compressing refrigerant gas in a corresponding plurality of cylinder bores;

said first end of said drive shaft extending outside said casing;

a pulley continuously coupled to said first end of said drive shaft for directly driving said drive shaft from a driving source;

a rigid support member protruding outwardly from said casing and disposed between said pulley and said first end of said drive shaft, said support member being formed integrally with said casing;

a first bearing disposed between said rigid support member and said pulley for receiving a thrust load and a radial load acting on said pulley when said pulley is rotatably driven by said driving source; and a second bearing disposed between said second end of said drive shaft and the adjacent one of said walls of said crank chamber for receiving a radial load acting on said pulley when said pulley is rotated; and said drive shaft being rotatably supported by only said first and second bearings.

10. A compressor according to claim 9, wherein said first bearing includes an angular contact ball bearing.

11. A compressor according to claim 9, wherein said second bearing comprises a cylinder slidably mounted on said second end of said drive shaft and reciprocatable along said drive shaft within a predetermined range; and said compressor further comprising urging means for urging said cylinder toward said disk to move said cylinder and said ball bearing to an extent based on the inclined angle of said disk.

12. A compressor according to claim 11, wherein said second bearing further comprises:

a ball bearing disposed between said cylinder and said second end of said drive shaft;

a ball engageable with said second end of said drive shaft; and a spring disposed between said casing and said second end of said drive shaft for urging said ball in the direction counter to said thrust load.

13. A compressor according to claim 11, wherein said casing includes:

a cylinder block having a front section and a rear section;

a front housing secured to said front section of said cylinder block;

a rear housing secured to said rear section of said cylinder block; and wherein said crank chamber is defined by said front housing and said cylinder block.

14. A compressor according to claim 13, further comprising a center portion and a peripheral portion formed with said rear housing, said center portion having a suction chamber and a suction passage for sucking the refrigerant gas into the suction chamber; and said peripheral portion having a discharge chamber; wherein said cylinder block defines a space for communicating said suction chamber with said suction passage and for accommodating said cylinder, wherein said cylinder selectively opens and closes said suction passage in accordance with said reciprocal movement of said cylinder.

15. A compressor according to claim 14, wherein said rear housing has a valve for controlling the pressure of the refrigerant gas in said crank chamber in response to the pressure of refrigerant gas in said suction passage.

16. A compressor comprising a rotary drive shaft having a first end and second end, said first and second ends being rotatably supported by opposing walls of a crank chamber defined in a casing, a disk tiltably mounted on said drive shaft and operably coupled to a plurality of pistons, such that rotation of said drive shaft results in reciprocating movement of said pistons for compressing refrigerant gas in a corresponding plurality of cylinder bores;

said first end of said drive shaft extending outside said casing;

a rotary member coupled to said first end of said drive shaft for directly driving said drive shaft from a driving source;

a rigid support member protruding outwardly from said casing and disposed between said rotary member and said first end of said drive shaft;

a first bearing disposed between said rigid support member and said rotary member for receiving a thrust load and a radial load acting on said rotary member when said rotary member is rotatably driven by said driving source;

a second bearing disposed between said second end of said drive shaft and the adjacent one of said walls of said crank chamber for receiving a radial load acting on said rotary member when said rotary member is rotated, said second bearing comprising a cylinder slidably mounted on said second end of said drive shaft and reciprocatable along said drive shaft within a predetermined range; and urging means for urging said cylinder toward said disk to move said cylinder to an extent based on the inclined angle of said disk.

17. The compressor according to claim 16, wherein said rotary member is a pulley.

* * * * *